US010571829B2

(12) United States Patent
Oya et al.

(10) Patent No.: US 10,571,829 B2
(45) Date of Patent: Feb. 25, 2020

(54) DEVELOPER TRANSPORTING DEVICE AND IMAGE FORMING APPARATUS

(71) Applicant: CANON KABUSHIKI KAISHA, Tokyo (JP)

(72) Inventors: Yoji Oya, Kawasaki (JP); Tomomichi Kawashima, Numazu (JP); Taisuke Hyodo, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/266,243

(22) Filed: Feb. 4, 2019

(65) Prior Publication Data

US 2019/0250535 A1 Aug. 15, 2019

(30) Foreign Application Priority Data

Feb. 9, 2018 (JP) ..... 2018-021949

(51) Int. Cl.
*G03G 15/08* (2006.01)

(52) U.S. Cl.
CPC ..... *G03G 15/0891* (2013.01); *G03G 15/0879* (2013.01)

(58) Field of Classification Search
CPC ..... G03G 15/0822; G03G 15/0844; G03G 15/0865; G03G 15/0877; G03G 15/0879; G03G 15/0887; G03G 15/0891; G03G 21/10; G03G 21/12; G03G 21/105
See application file for complete search history.

(56) References Cited

U.S. PATENT DOCUMENTS

2010/0239340 A1* 9/2010 Akaike ..... G03G 21/105 399/358

FOREIGN PATENT DOCUMENTS

JP S61-77877 A 4/1986

* cited by examiner

*Primary Examiner* — Thomas S Giampaolo, II
(74) *Attorney, Agent, or Firm* — Venable LLP

(57) ABSTRACT

A developer transporting device includes a first transport passage through which a developer is transported in a first direction along a direction oriented downwardly in a direction of gravity, and a second transport passage which communicates with the first transport passage on a downstream side of the first transport passage and through which the developer is transported in a second direction along a direction oriented upwardly. The first transport passage is provided with a first transport force generating member which generates a transport force for transporting the developer in the first direction, and the second transport passage is provided with a second transport force generating member which generates a transport force for transporting the developer in the second direction.

9 Claims, 9 Drawing Sheets

DEVELOPER TRANSPORTING DEVICE AND IMAGE FORMING APPARATUS

BACKGROUND OF THE INVENTION

Field of the Invention

The present invention relates to a developer transporting device in an image forming apparatus such as a copier or a printer.

Description of the Related Art

In an image forming process using an electrophotographic system, each developer image formed on a surface of a photosensitive drum that functions as an image bearing member of each color of yellow, magenta, cyan, and black is sequentially primarily transferred onto an outer circumferential surface of an intermediate transfer belt from the photosensitive drum surface and developer images of the four colors are superimposed on each other. The color developer image formed on the outer circumferential surface of the intermediate transfer belt is secondarily transferred in a secondary transfer nip portion from the outer circumferential surface of the intermediate transfer belt to a surface of a recording material, and an unfixed developer image is formed on the surface of the recording material. Residual developer remaining on the outer circumferential surface of the intermediate transfer belt after the secondary transfer process is removed from the outer circumferential surface of the intermediate transfer belt by a belt cleaner unit and subsequently stored in a recovery container provided so as to be attachable to and detachable from an image forming apparatus main body. Once a prescribed amount of the residual developer is stored in the recovery container, information prompting a user to replace the recovery container is displayed on a display portion such as an operating panel and the recovery container is replaced by the user.

An increase in a capacity of recovery containers is required in order to reduce the frequency of replacement of recovery containers which is troublesome for users. With the downsizing of image forming apparatuses, in order to arrange a large-capacity recovery container inside an image forming apparatus, the recovery container may be arranged in an upper portion inside the image forming apparatus in order to avoid regions where an image forming portion and a recording material transporting device are arranged, when considering the structure of the image forming apparatus. Arranging the recovery container higher than an intermediate transfer belt necessitates a configuration that enables a residual developer to be transported from a belt cleaner unit to the recovery container arranged higher than the belt cleaner unit or, in other words, a configuration that enables the developer to be transported upward from below.

In order to smoothly transport a developer in a developer transporting device that transports a developer upward from below against the direction of gravity, the developer must be proactively introduced in to a transport path for transporting the developer upward from below. To this end, a configuration is conceivable in which a buffer portion that allows a developer to accumulate is provided between a transport path for transporting the developer upward from below and a belt cleaner unit, and the developer is supplied from the buffer portion to the transport path. A configuration is also conceivable in which a developer transport member is used for a handover to supply the developer from the buffer portion to the transport path.

With developing apparatuses used in image forming apparatuses, there is a configuration in which, in order to cause a developer to be uniformly diffused inside a developing apparatus, two spiral transport members which respectively transport the developer in opposite directions are arranged in parallel and cause the developer to circulate inside the developing apparatus. To this end, an upstream-side spiral transport member guides and hands over the developer to a downstream-side transport path.

In Japanese Patent Application Laid-open No. S61-77877, a partition member is provided between two spiral transport members which are vertically arranged in parallel. In addition, a developer transported by an upper spiral transport member is handed over to a lower spiral transport member from a first supply port provided in a vicinity of one end of the partition member in a longitudinal direction and a chute portion provided on a transverse direction side of the partition member. Furthermore, the developer transported by the lower spiral transport member is handed over to the upper spiral transport member from a second supply port provided in a vicinity of another end of the partition member in the longitudinal direction. Accordingly, the developer is smoothly circulated and transported inside the developing apparatus and diffused in a favorable manner.

SUMMARY OF THE INVENTION

However, the configuration disclosed in Japanese Patent Application Laid-open No. S61-77877 is a configuration in which two spiral transport members provided above and below supply a developer to each other. Considering that the developer is supplied to a transport path through which the developer is transported upward from below against the direction of gravity, a buffer portion capable of supplying the developer with even greater efficiency is required. In addition, from the perspective of downsizing the image forming apparatus, the buffer portion also must be formed in a space-saving manner.

The present invention solves the problem described above and an object thereof is to configure a developer transporting device capable of smoothly transporting a developer upward from below in a space-saving manner.

In order to achieve the object described above, a developer transporting device according to the present invention includes:

a first transport passage through which a developer is transported in a first direction along a direction oriented downwardly in the direction of gravity; and a second transport passage which communicates with the first transport passage on a downstream side of the first transport passage when the developer is transported in the first direction, and through which the developer is transported in a second direction along a direction oriented upwardly in the direction of gravity, wherein the first transport passage is provided with a first transport force generating member which generates a transport force for transporting the developer in the first direction, and wherein the second transport passage is provided with a second transport force generating member which generates a transport force for transporting the developer in the second direction.

In addition, in order to achieve the object described above, an image forming apparatus according to the present invention includes:

an image bearing member which bears a developer image constituted by a developer; and the developer transporting device described above which transports the developer recovered from the image bearing member.

According to the present invention, a developer transporting device capable of smoothly transporting a developer upward from below can be configured in a space-saving manner.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
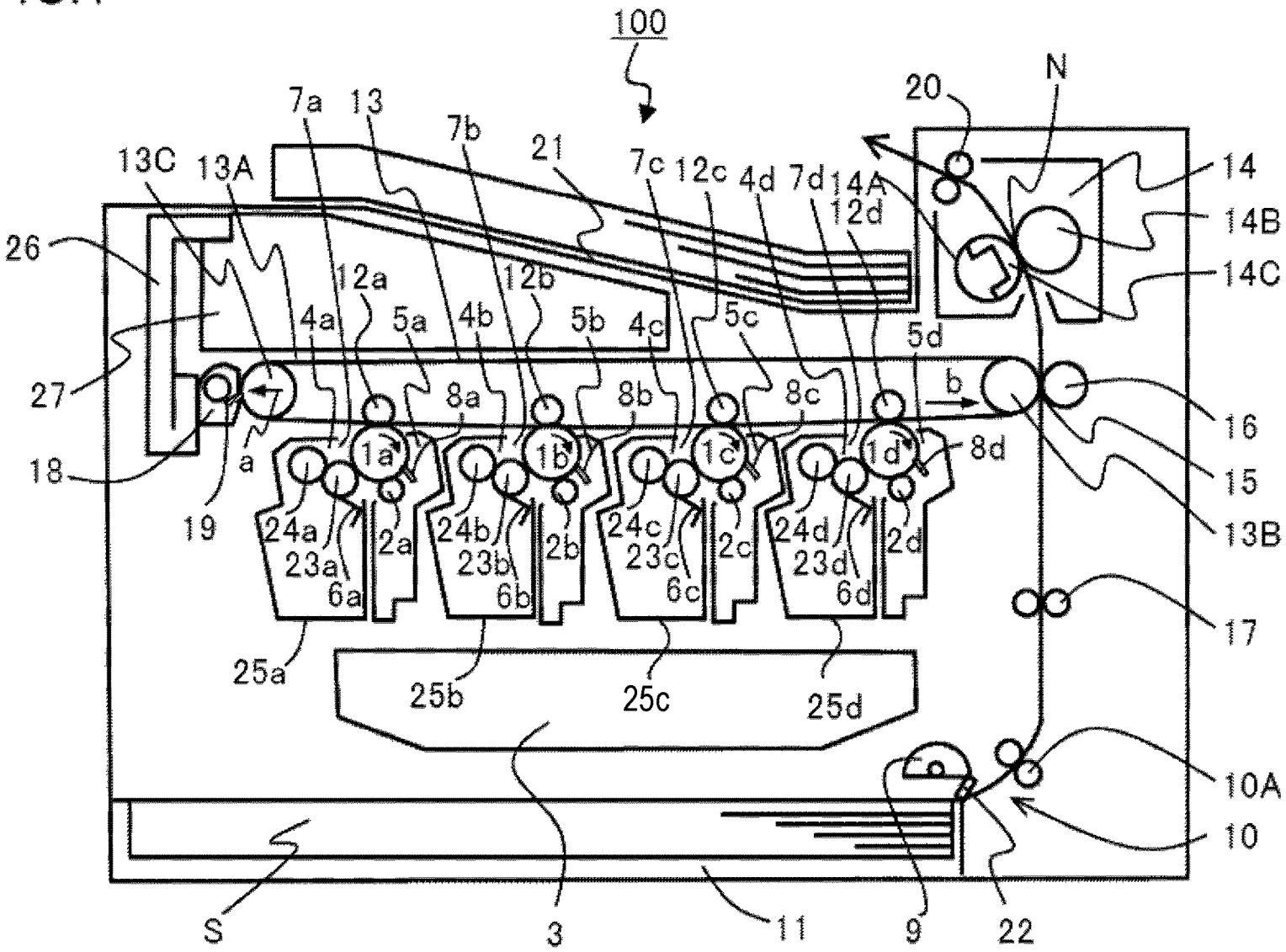
FIG. 1 is a sectional explanatory diagram showing a configuration of an image forming apparatus according to the present invention.
Figure 2A:
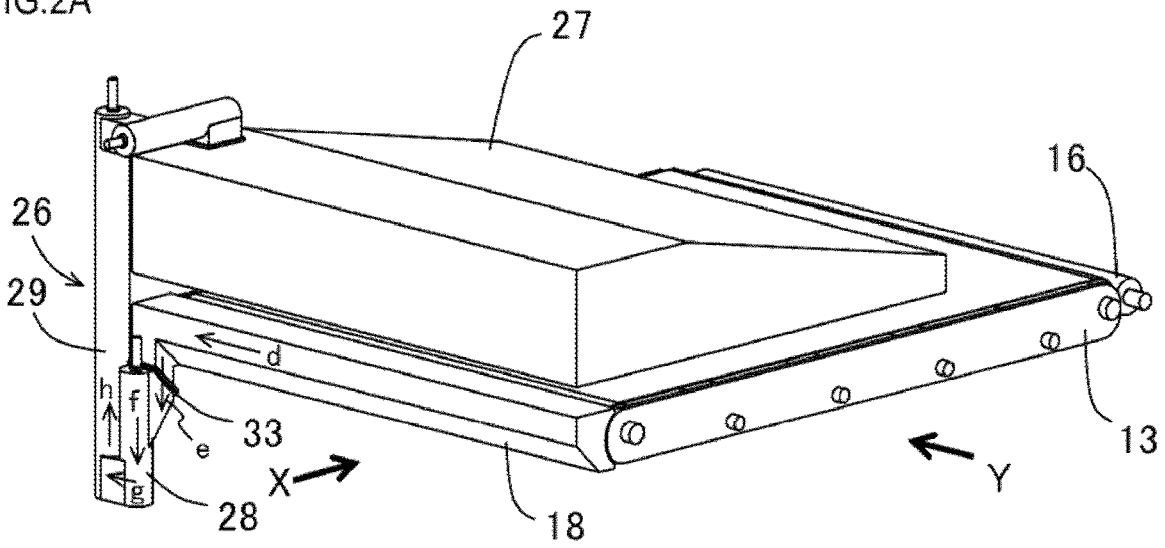
FIGS. 2A to 2C are diagrams showing a configuration of a developer transporting device according to a first embodiment.
Figure 2B:
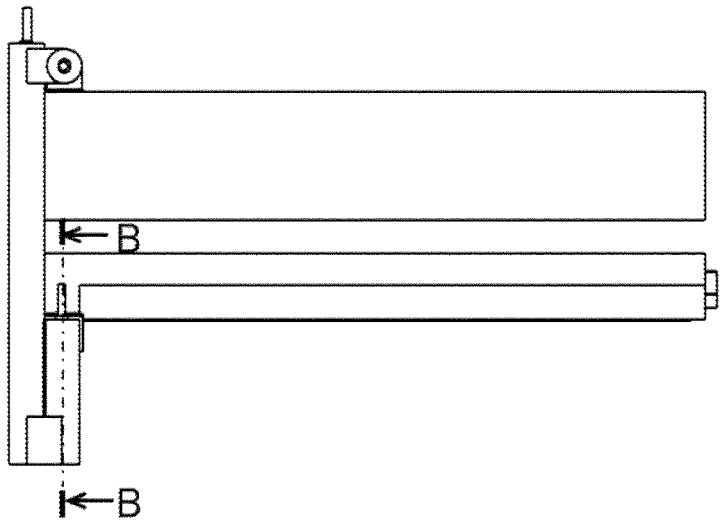
Figure 2C:
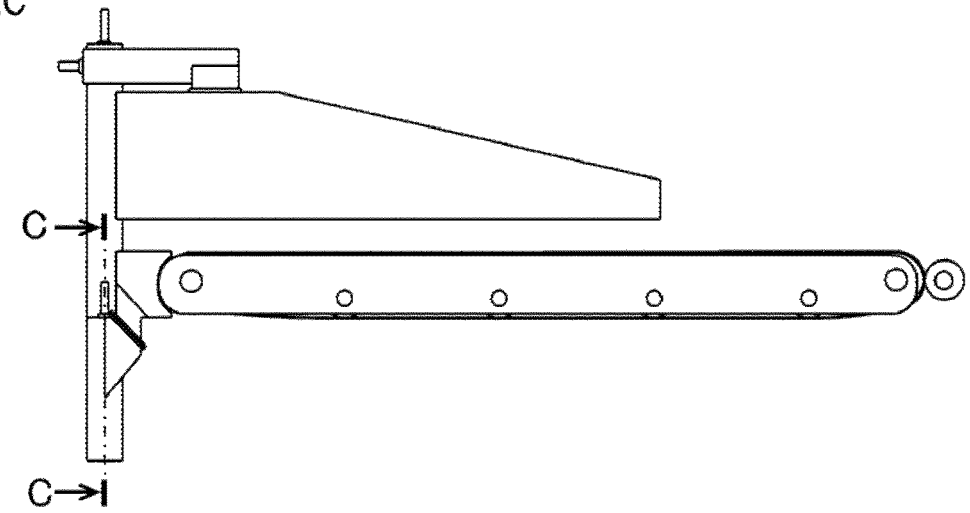
Figure 3:
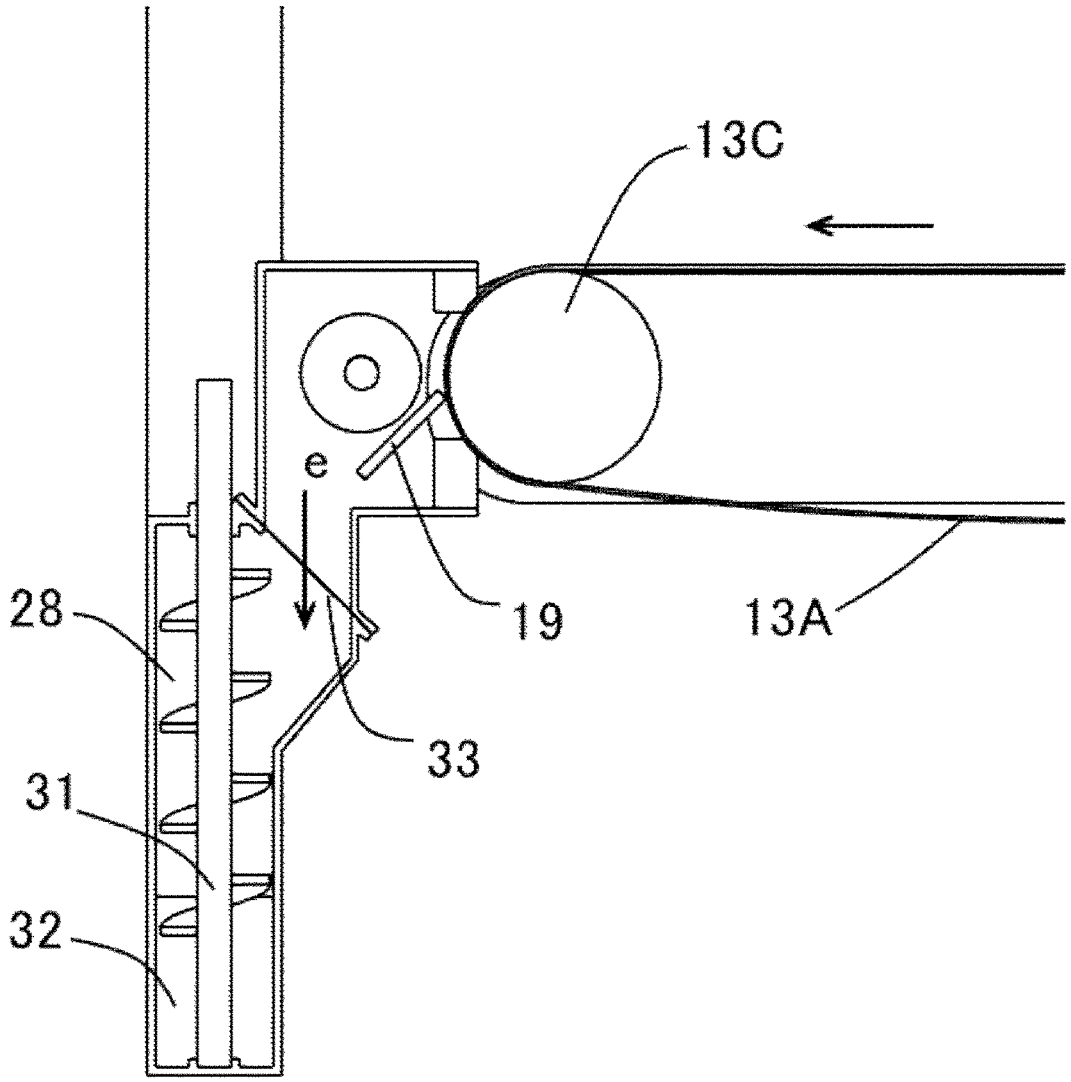
FIG. 3 is a sectional explanatory diagram taken along B-B in FIG. 2B.
Figure 4:
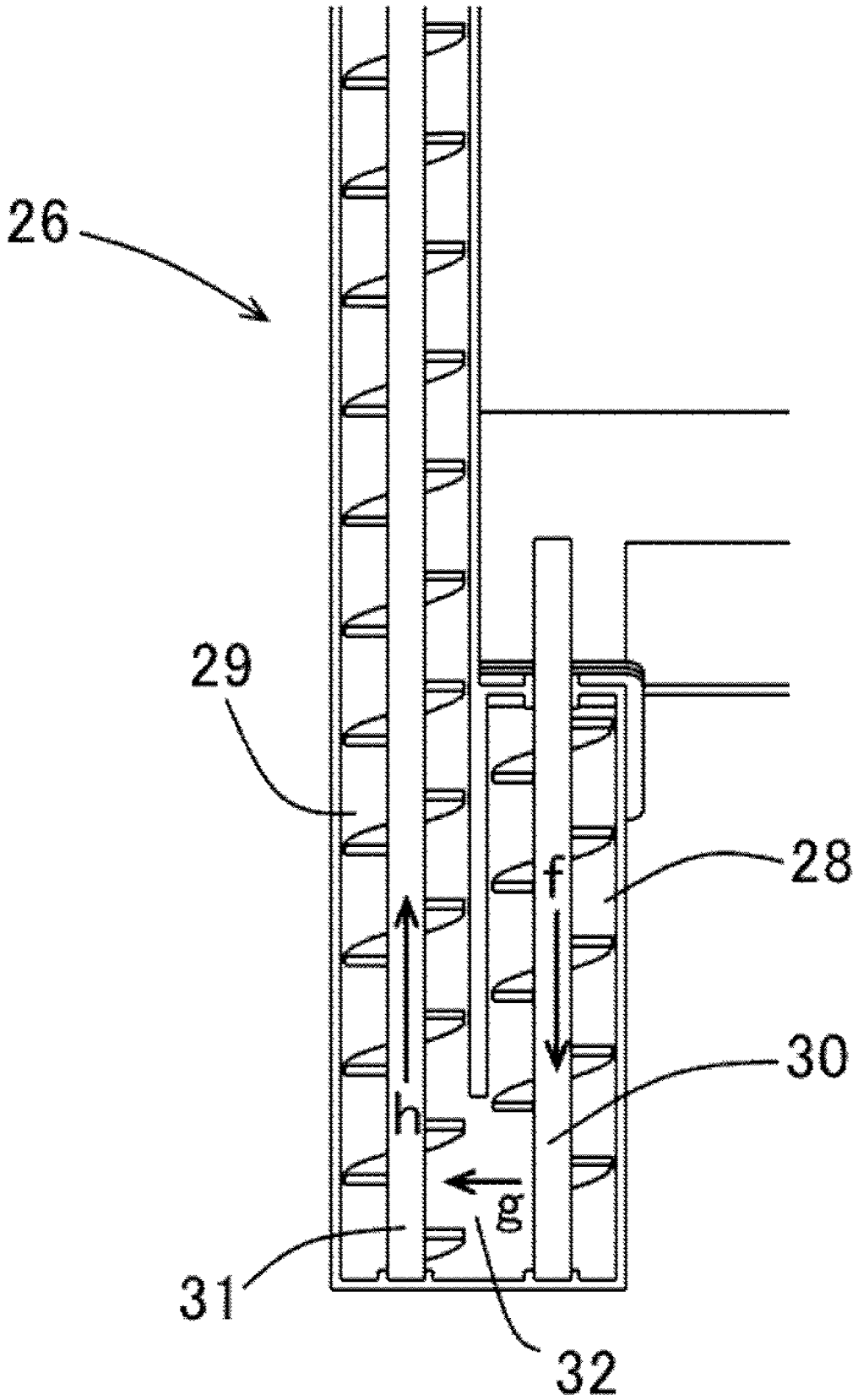
FIG. 4 is a sectional explanatory diagram taken along C-C in FIG. 2C.
Figure 5A:
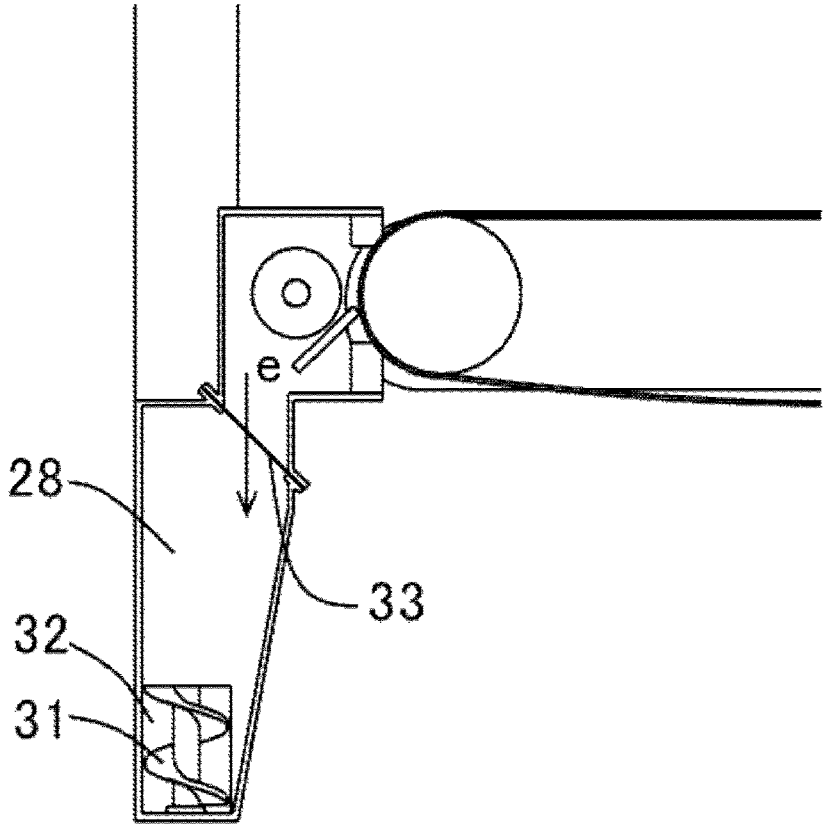
FIGS. 5A and 5B are sectional explanatory diagrams of a comparative example corresponding to the B-B sectional explanatory diagram according to the first embodiment.
Figure 5B:
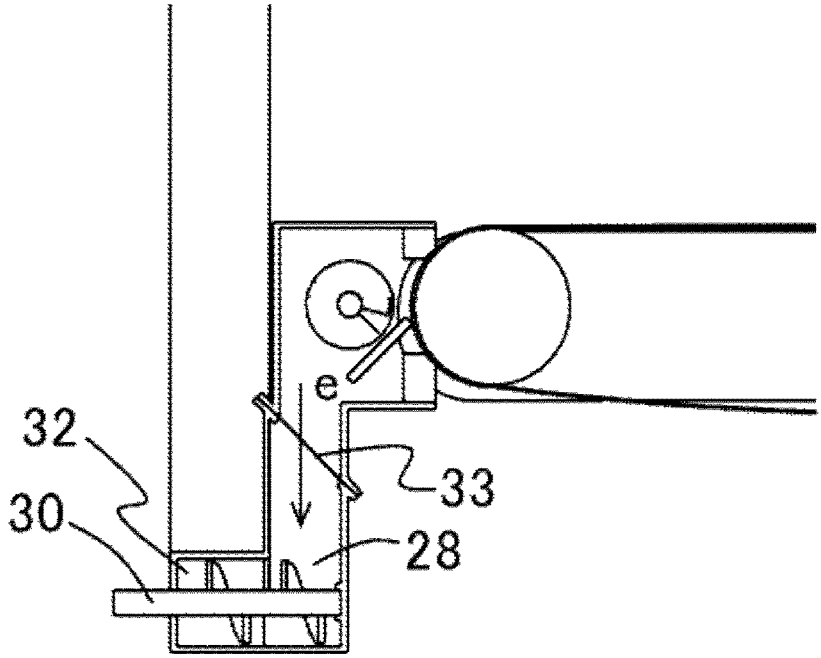
Figure 6:
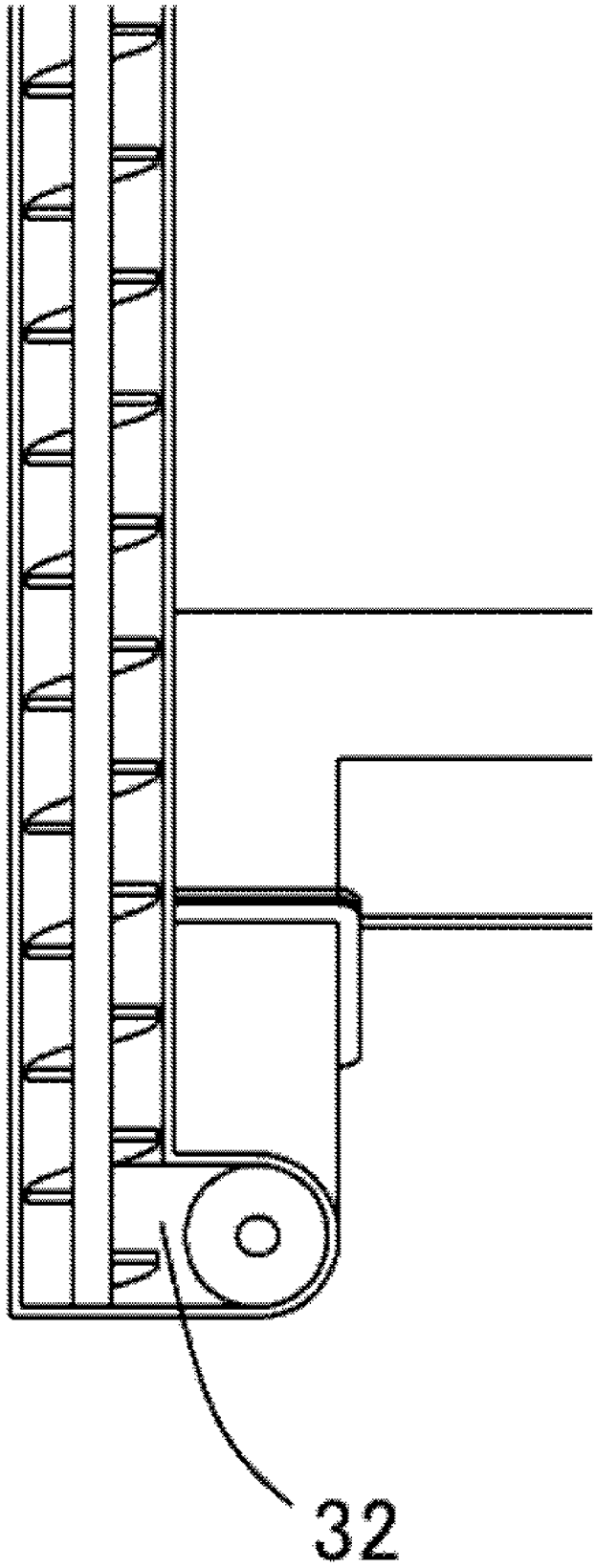
FIG. 6 is a sectional explanatory diagram of a comparative example corresponding to the C-C sectional explanatory diagram according to the first embodiment.

First, a configuration of a first embodiment of a developer transporting device according to the present invention will be described with reference to FIGS. 1 to 6. FIG. 1 is a sectional explanatory diagram showing a configuration of an image forming apparatus according to the present invention. FIGS. 2A to 2C are perspective explanatory diagrams and sagittal explanatory diagrams showing a configuration of a developer transporting device according to the first embodiment. FIG. 3 is a sectional explanatory diagram taken along B-B in FIG. 2B. FIG. 4 is a sectional explanatory diagram taken along C-C in FIG. 2C. FIGS. 5A and 5B are sectional explanatory diagrams of a comparative example corresponding to the B-B sectional explanatory diagram according to the first embodiment. FIG. 6 is a sectional explanatory diagram of a comparative example corresponding to the C-C sectional explanatory diagram according to the first embodiment.

Image Forming Apparatus

An image forming apparatus 100 shown in FIG. 1 has a plurality of photosensitive drums 1*a* to 1*d* that function as image bearing members. Each of the photosensitive drums 1*a* to 1*d* rotates clockwise in FIG. 1. For the sake of brevity, descriptions may be given simply using the term photosensitive drum 1 to represent the respective photosensitive drums 1*a* to 1*d*. Other image forming process unit will be described in a similar manner. A charging roller 2 as a charging member, exposing unit 3 as an image exposing portion, a developing unit 4 as a developing portion, and a drum cleaning blade 8 as a cleaning member are respectively provided around the photosensitive drum 1. An intermediate transfer unit 13 that is an example of an image bearing member as a transfer unit for transferring a developer image formed on a surface of each photosensitive drum 1 to a recording material S is provided with respect to the surface of each photosensitive drum 1. The intermediate transfer unit 13 is provided with an intermediate transfer belt 13A which is rotatably tautened counterclockwise in FIG. 1 by a driver roller 13B and a tension roller 13C. Tension is applied to the tension roller 13C in a direction of an arrow a in FIG. 1 by a biasing unit (not shown). A primary transfer roller 12 that functions as a primary transfer member is provided on a side of an inner peripheral surface of the intermediate transfer belt 13A so as to oppose the surface of each photosensitive drum 1. A primary transfer bias is applied to each primary transfer roller 12 from a primary transfer bias power supply (not shown).

Image Forming Operation

The surface of each photosensitive drum 1 is uniformly charged by each charging roller. The surface of the uniformly charged photosensitive drum 1 is irradiated by light in accordance with image information by the exposing unit 3 to form an electrostatic latent image on the surface of the photosensitive drum 1. A developer is stored in each developer container 25 provided in each developing unit 4. Each developing roller 23 that functions as a developer bearing member supplies the developer to the electrostatic latent image formed on the surface of each photosensitive drum 1 and causes the developer to adhere to the electrostatic latent image, thereby developing and making the electrostatic latent image visible as a developer image. The developer image formed on the surface of each photosensitive drum 1 is sequentially transferred and superimposed on an outer circumferential surface of the intermediate transfer belt 13A rotating counterclockwise in FIG. 1 as a primary transfer bias is applied to each primary transfer roller 12 by a primary transfer bias power supply (not shown). Residual developer that remains on the surface of the photosensitive drum 1 after primary transfer is scraped off and removed by each drum cleaning blade 8.

Image Forming Process

In the present embodiment, the photosensitive drum 1, the charging roller 2, the developing unit 4, and the drum cleaning blade 8 are integrally configured and form a process cartridge 7 that is a process unit. The process cartridge 7 is configured to be attachable to and detachable from the image forming apparatus 100. It should be noted that a process cartridge is configured so as to integrally include the photosensitive drum 1 and at least one of process unit that acts on the photosensitive drum 1, and is configured to as to include the developing unit 4 and a drum cleaner unit 5. In this case, the process unit described above refers to charging member, developing portion, cleaning member, and the like. In addition, the developing unit 4 is constituted by the developing roller 23 which causes the developer to adhere to the surface of the photosensitive drum 1, an application roller 24 which applies the developer to a surface of the developing roller, a developing blade 6 which restricts a layer thickness of the developer borne on the surface of the developing roller 22, and a developer container 25. The drum cleaner unit 5 is configured to include the photosensitive drum 1, the charging roller 2, and the drum cleaning blade 8.

The photosensitive drum 1 is constructed by applying an organic photoconductor (OPC) layer on an outer circumferential surface of an aluminum cylinder. Flanges are provided at both ends of the photosensitive drum 1 in an axial direction thereof and the photosensitive drum 1 is rotatably supported by the flanges. A driving force is transmitted to one end of the photosensitive drum 1 in the axial direction from a drive motor (not shown) and, accordingly, the photosensitive drum 1 rotates clockwise in FIG. 1.

The charging roller 2 that functions as the charging member is constituted by a conductive roller formed in a roller shape. The charging roller 2 is brought into contact with the surface of the photosensitive drum 1 and a charging bias voltage is applied to the charging roller 2 from a charging bias power supply (not shown). Accordingly, the surface of the photosensitive drum 1 is uniformly charged.

The exposing unit 3 is arranged below the process cartridge 7 and irradiates the photosensitive drum 1 with light based on an image signal.

The developing unit 4 is provided with the developer container 24 constituted by a frame body that stores the developer. In addition, the developing roller 23 is provided in each developer container 25. Each developing roller 23 is provided so as to oppose the surface of each photosensitive drum 1 and is rotationally driven by a motor (not shown) that functions as a driving source. Due to a developing bias voltage applied by a developing bias power supply (not shown), the developer of each color which is borne on the surface of each developing roller 23 is supplied to the electrostatic latent image formed on the surface of the photosensitive drum 1 and developed as a toner image.

After the surface of the photosensitive drum 1 is charged to a prescribed potential with negative polarity by the charging roller 2 as the charging member, the electrostatic latent image is formed by the exposing unit 3 as the image exposing portion. Subsequently, the developing unit 4 causes the developer with negative polarity to adhere to the electrostatic latent image formed on the surface of the photosensitive drum 1 and, accordingly, the electrostatic latent image is developed and made visible as a developer image.

The intermediate transfer belt 13A is rotated in a direction of an arrow b in FIG. 1 and, when a bias with positive polarity is applied to the primary transfer roller 12 from a primary transfer bias power supply (not shown), the developer images of the photosensitive drum 1*a* to the photosensitive drum 1*d* are sequentially primarily transferred onto the intermediate transfer belt 13A. In a state where developer images of four colors are superimposed on the outer circumferential surface of the intermediate transfer belt 13A, a recording material S is transported to a secondary transfer nip portion 15 which is opposed by a secondary transfer roller 16 that functions as a secondary transfer unit.

A transporting apparatus 10 has a feeding roller 9 which feeds the recording material S from inside a feeding cassette 11 which stores the recording material S and a separating pad 21 which separates the recording material S fed from the feeding roller 9. The transporting apparatus 10 also has a transporting roller 10A which sandwiches and transports the recording material S separated into single sheets and fed by collaboration between the feeding roller 9 and the separating pad 21.

The feeding cassette 11 is provided so as to be attachable to and detachable from the main body of the image forming apparatus 100. A replenishing operation of the recording material S is completed as a user pulls out the feeding cassette 11 from the main body of the image forming apparatus 100 and, after setting the recording material S, once again inserts the feeding cassette 11 into the main body of the image forming apparatus 100.

The recording material S stored in the feeding cassette 11 is brought into pressure contact with and is fed out by the feeding roller 9 and separated into single sheets and fed by collaboration between the feeding roller 9 and the separating pad 21. Subsequently, a leading end of the recording material S sandwiched and transported by the transporting roller 10A abuts against a nip portion of a resist roller 17, the recording material S is handled in accordance with its stiffness to correct skewing thereof, and the recording material S is transported to the secondary transfer nip portion 15.

In the secondary transfer nip portion 15, a bias with positive polarity is applied to the secondary transfer roller 16 by a secondary transfer bias power supply (not shown). Accordingly, the developer images borne on the outer circumferential surface of the intermediate transfer belt 13A are secondarily transferred to the recording material S having been transported to the secondary transfer nip portion 15. At this point, the image formed on the recording material S is an unfixed image carrying the developer. Residual developer that remains, after secondary transfer that is after image formation, on the outer circumferential surface of the intermediate transfer belt 13A that is an image bearing member is scraped off and removed by a belt cleaning blade 19 included in a belt cleaner unit 18 that is a belt cleaning portion. Subsequently, the residual developer is handed over from the belt cleaner unit 18 to a developer transporting device 26 that is a developer transport unit, and after being transported by the developer transporting device 26 to a recovery container 27 that is a developer container, the residual developer is stored in the recovery container 27. The recovery container 27 is provided so as to be attachable to and detachable from the main body of the image forming apparatus 100, and once a prescribed amount of the residual developer fills the recovery container, the recovery container is replaced by the user.

Fixing Apparatus

A fixing apparatus 14 that functions as fixing unit for fixing a toner image formed on the recording material S by an image forming portion 30 applies heat and pressure to fix an unfixed developer image having been secondarily transferred onto the recording material S. The fixing apparatus 14 has an endless fixing belt 14A, an elastic pressure roller 14B, and a guiding member 14C to which a heating member such as a heater is bonded. The pressure roller 14B sandwiches the fixing belt 14A between the pressure roller 14B and the guiding member 14C, and a fixing nip portion N with a prescribed width is formed as the pressure roller 14B is brought into pressure contact with the guiding member 14C at a prescribed pressure contact force. The pressure roller 14B is rotationally driven clockwise in FIG. 1 by a motor that functions as a driving source (not shown). The fixing belt 14A is driven by the pressure roller 14B due to a friction force between the fixing belt 14A and the pressure roller 14B and rotates counterclockwise in FIG. 1. At this point, the fixing belt 14A is heated by the heater provided on the guiding member 14C. In a state where the fixing nip portion N has been heated to and adjusted at a prescribed temperature, the recording material S on which an unfixed developer image is formed is introduced between an outer circumferential surface of the fixing belt 14A and the pressure roller 14B of the fixing nip portion N. Once an image surface of the recording material S is introduced so as to oppose the outer circumferential surface of the fixing belt 14A, the image surface of the recording material S comes into close contact with the outer circumferential surface of the fixing belt 14A in the fixing nip portion N and is sandwiched by and transported through the fixing nip portion N. During the process of the recording material S being sandwiched by and transported through the fixing nip portion N together with the outer circumferential surface of the fixing belt 14A, the recording material S is heated by heat of a heater provided on a side of an inner circumferential surface of the fixing belt 14A and the unfixed toner image on the recording material S is melted and fixed by heat. The recording material S on which the toner has been fixed by heat is sandwiched and transported by a discharge roller 19 and discharged onto a discharge tray 20.

Developer Transporting Device

Next, a configuration of the developer transporting device according to the present embodiment will be described. The developer transporting device according to the present embodiment is provided with a buffer portion 28 that is a first transport passage for receiving a developer from the belt cleaner unit 18 and an upward transport path 29 that is a second transport passage through which the developer is transported upward from below. In addition, the developer transporting device is constituted by first transport member 30 through which the developer is transported downward from above in a direction of gravity inside the buffer portion 28 that is the first transport passage and second transport member 31 through which the developer is transported upward from below in the upward transport path 29 that is the second transport passage. Since the first transport member 30 and the second transport member 31 described above have spiral shapes (to be described later) and since one may argue that the first transport member 30 and the second transport member 31 generate a transport force for transporting the developer, the first transport member 30 can also be referred to as first transport force generating member and the second transport member 31 can also be referred to as second transport force generating member. As shown in FIG. 2A, the developer that remains after secondary transfer on the outer circumferential surface of the intermediate transfer belt 13A is scraped off by the belt cleaning blade 19 included in the belt cleaner unit 18 that is a cleaning apparatus. Subsequently, the developer is first transported in a direction of an arrow d through the belt cleaner unit 18 by a transport member (not shown) and next handed over to the buffer portion 28 that is the first transport passage from the belt cleaner unit 18 (an arrow e in FIG. 2A). Next, the developer is transported downward from above by the first transport member 30 as the first transport force generating member through the buffer portion 28 from a first inflow portion at which the developer flows in to a first outflow portion which is positioned lower than the first inflow portion and from which the developer flows out (an arrow fin FIG. 2A). Next, the developer passes a second inflow portion from the first outflow portion of the buffer portion 28 and is supplied to the upward transport path 29 that is the second transport passage (an arrow g in FIG. 2A). Subsequently, the developer is transported upward from below inside the upward transport path 29 that is the second transport passage by the second transport member 31 as the second transport force generating member from the second inflow portion described above to a second outflow portion connected to the developer container (an arrow h in FIG. 2A). As shown in FIG. 4, in the developer transporting device 26 according to the present embodiment, the buffer portion 28 is provided with the first transport member 30 as a first rotating member which has a spiral shape, and the buffer portion 28 is a transport passage that transports the developer downward from above.

The developer transported through the buffer portion 28 is supplied via an opening 32 provided on a downstream side in a transport direction to the upward transport path 29 which is arranged in parallel and in proximity with the buffer portion 28. The opening 32 refers to a communication port which connects the buffer portion 28 that is the first transport passage to the upward transport path that is the second transport passage and which enables the developer to circulate. In addition, the opening 32 that is the communication port is provided in a direction perpendicular to a transport direction in the buffer portion 28 that is the first transport passage and in a portion common to a part of the buffer portion 28 that is the first transport passage and a part of the upward transport path 29 that is the second transport passage. In other words, a configuration is adopted in which, in the buffer portion 28 on an upstream side of the upward transport path 29 as the second transport passage for transporting the developer upward from below, the developer is transported in an opposite direction to the transport direction in the upward transport path 29. Accordingly, the effects of efficient supply of the developer from the buffer portion 28 that is the first transport passage to the upward transport path 29 that is the second transport passage, downsizing of the buffer portion 28, and prevention of clogging and scattering of the developer in the buffer portion 28 can be achieved.

Comparative examples with the present embodiment are shown in FIGS. 5A and 5B. FIG. 5A represents a comparative example when the buffer portion 28 is not provided with transport member and FIG. 5B represents a comparative example when the buffer portion 28 intersects with the upward transport path 29. In order to smoothly transport the developer upward from below in the upward transport path 29, the developer must be proactively supplied from the opening 32 that is the communication port to the upward transport path 29. To this end, when the buffer portion 28 is not provided with the transport member as in the comparative example shown in FIG. 5A, the opening 32 that is the communication port must by filled with the developer by creating the buffer portion 28 so as to have a certain capacity and accumulating the developer therein. Furthermore, as shown in FIG. 5A, an inclined surface must be provided inside the buffer portion 28 to cause the developer to flow toward the opening 32 that is the communication port. As a result, a volume of the developer transporting device 26 increases. In addition, since the developer is accumulated in the buffer portion 28, an amount of residual developer increases. Accordingly, there are increased risks of solidification of the developer when the image forming apparatus is not operated for a long period of time and leakage or scattering of the developer when the image forming apparatus is subjected to vibration during transportation. In addition, handover of the developer between two transport paths is performed at the opening 32 as the communication port that functions as a supplying portion of the developer from the buffer portion 28 to the upward transport path 29. In consideration thereof, from the perspective of preventing clogging at the opening, a cross-sectional area of the opening 32 that is the communication port is desirably larger than a cross-sectional area of the buffer portion 28 on the upstream side of the opening 32. Stated differently, an opening area of the opening 32 that is the communication port is desirably larger than a cross-sectional area of a cross section perpendicular to the transport direction inside the buffer portion 28 that is the first transport passage. In other words, a cross-sectional area on the side of the second inflow portion described above is desirably larger than a cross-sectional area on the side of the first outflow portion described above. As shown in FIG. 6, when the buffer portion 28 intersects with the upward transport path 29, it is difficult to increase the cross-sectional area of the opening 32. However, when the buffer portion 28 that is the first transport passage and the upward transport path 29 that is the second transport passage are arranged in parallel as in the present embodiment, the cross-sectional area of the opening 32 can be readily increased.

From the perspective of preventing clogging at the opening 32 that is the communication port, a transport force of the first transport member 30 provided in the buffer portion 28 that is the first transport passage on the upstream side is set smaller than a transport force of the second transport member provided in the upward transport path 29 that is the second transport passage on the downstream side. In other words, a transport force generated by the first transport force generating member is smaller than a transport force generated by the second transport force generating member. In transport member having a spiral shape, items that affect a transport force include a diameter of a central shaft of spiral transport member, an outer diameter of the spiral shape, a pitch of the spiral shape, and rotational speed. In the present embodiment, diameters of central shafts of the spiral transport member, outer diameters of the spiral shapes, and pitches of the spiral shapes of the first transport member 30 and the second transport member 31 are equal to each other. The transport force of the first transport member 30 that is the first rotating member is set smaller than the transport force of the second transport member 31 that is a second rotating member by setting the rotational speed of the first transport member lower than the rotational speed of the second transport member. However, this configuration is not restrictive and any of the items described above with the exception of rotational speed or a combination of a plurality of the items described above may be used to set the transport force of the first transport member smaller than the transport force of the second transport member.

Figure 7:
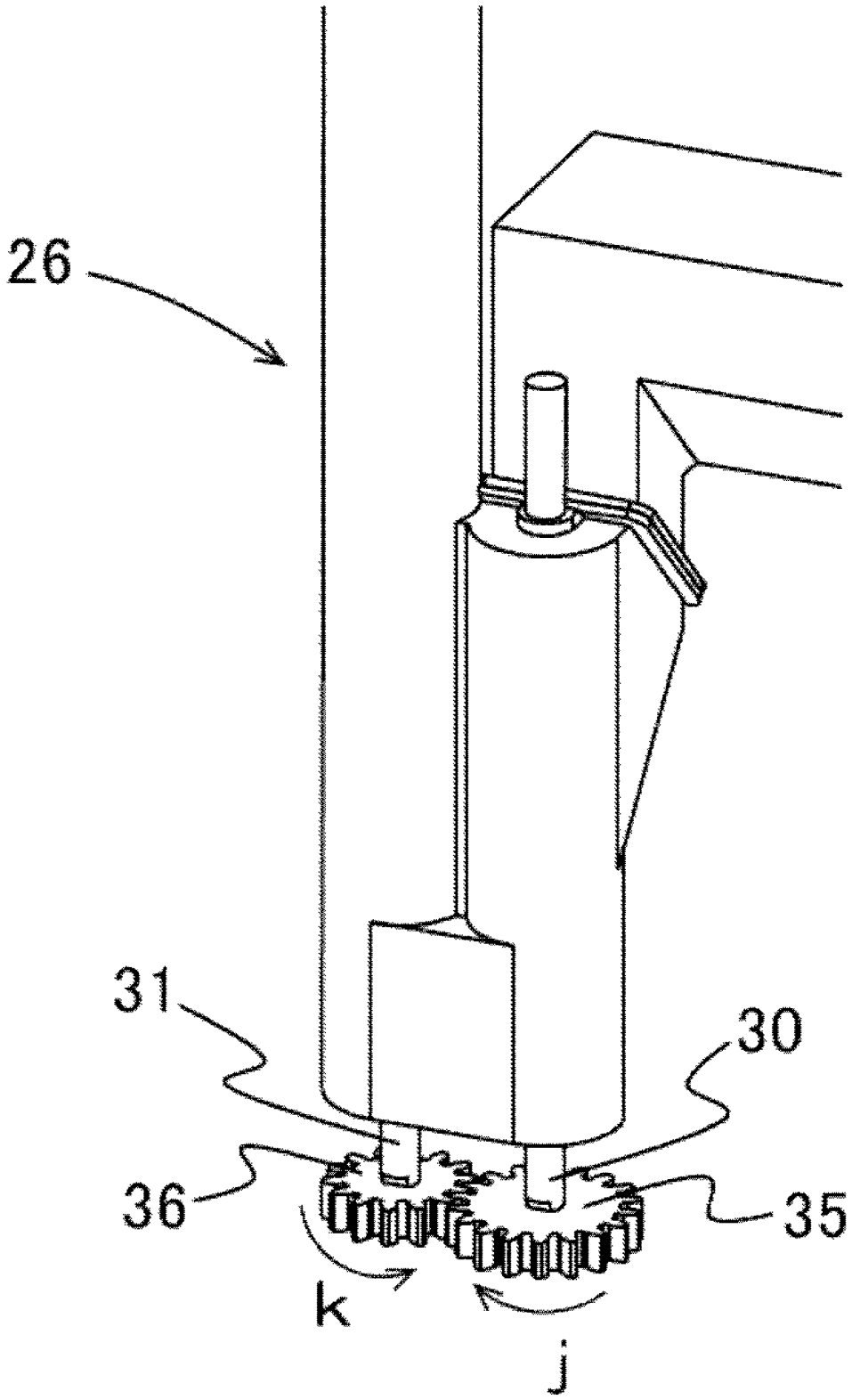
FIG. 7 is a perspective explanatory diagram showing a drive configuration of a transport member according to the first embodiment.

In addition, in the present embodiment, a rotation direction of the first transport member 30 that is the first rotating member is opposite to a rotation direction of the second transport member 31 that is the second rotating member. Accordingly, a drive configuration for rotating the first transport member 30 and the second transport member 31 can be constructed in a simple and space-saving manner. When two transport members having spiral shapes are arranged in parallel to each other and respectively rotated as in the present embodiment, a configuration is conceivable in which the rotation of one of the transport members is transmitted to the other transport member. In this case, as shown in FIG. 7, a gear 1 as a first gear provided at an end of the first transport member 30 in a direction of a rotational axis thereof and a gear 2 as a second gear provided at an end of the second transport member 31 in a direction of a rotational axis thereof are arranged so as to be meshed and directly coupled with each other. Accordingly, drive transmission between the transport members can be configured in a simple and space-saving manner. When the gear 1 and the gear 2 are directly coupled with each other, the rotation direction (an arrow j in FIG. 7) of the first transport member 30 and the rotation direction (an arrow k in FIG. 7) of the second transport member 31 become opposite directions. By making twist directions of the spiral shapes of the first transport member 30 and the second transport member 31 the same, a transport force oriented downward from above is obtained by the first transport member 30 and a transport force oriented upward from below is obtained by the second transport member 31.

According to the present embodiment, a developer transporting device capable of smoothly transporting a developer upward from below in a direction of gravity can be configured in a space-saving manner.

Second Embodiment

Figure 8:
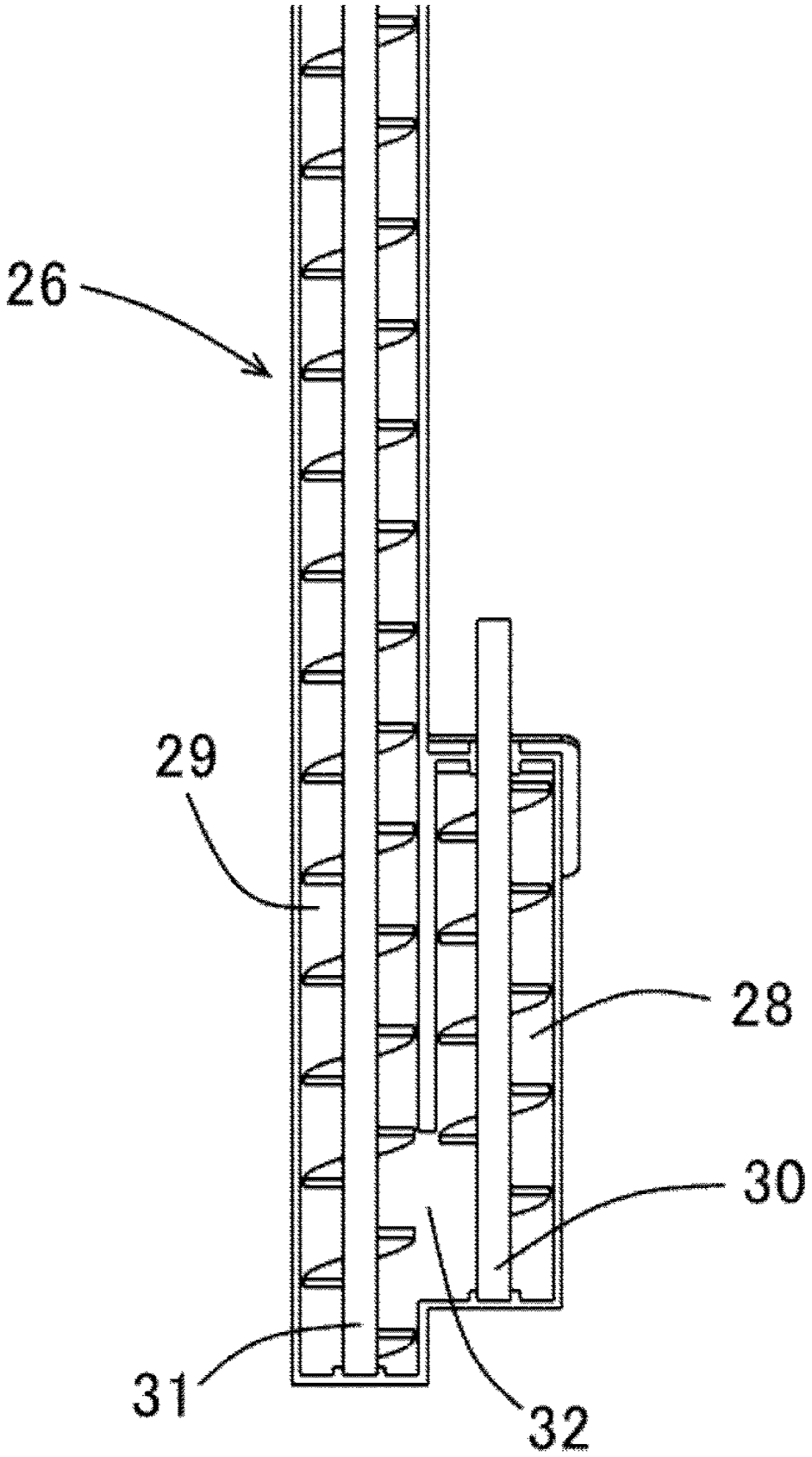
FIG. 8 is a sectional explanatory diagram of a transport member according to a second embodiment.

Next, a configuration of a second embodiment of the present invention will now be described with reference to FIG. 8. The present embodiment adopts a configuration in which a lower end portion of the spiral shape of the second transport member 31 that is the second rotating member provided in the upward transport path 29 is positioned lower than a lower end portion of the spiral shape of the first transport member 30 that is the first rotating member provided in the buffer portion 28. In addition, the lower end portion of the spiral shape of the second transport member 31 that is the second rotating member having a spiral shape and being provided in the upward transport path 29 is formed from a position lower than a lower end of the opening 32 that is the communication port. In other words, the second transport member 31 extends lower than a coupling portion between the buffer portion 28 that is the first transport passage and the upward transport path 29 that is the second transport passage.

When the spiral shape of the second transport member 31 is formed from a position higher than the lower end of the opening 32, the developer supplied to the upward transport path 29 is unable to obtain the transport force of the second transport member 31 in a range extending from the lower end of the opening 32 to a lower end of the spiral shape of the second transport member 31. As a result, the developer ends up accumulating on a downstream side of the upward transport path 29. In order to prevent this accumulation of the developer, the spiral shape of the second transport member 31 must be formed from a position lower than the lower end of the opening 32. Accordingly, the developer supplied via the opening 32 that is the coupling portion from the buffer portion 28 that is the first transport passage to the upward transport path 29 that is the second transport passage can be transported without leakage by the second transport member 31.

Third Embodiment

Figure 9:
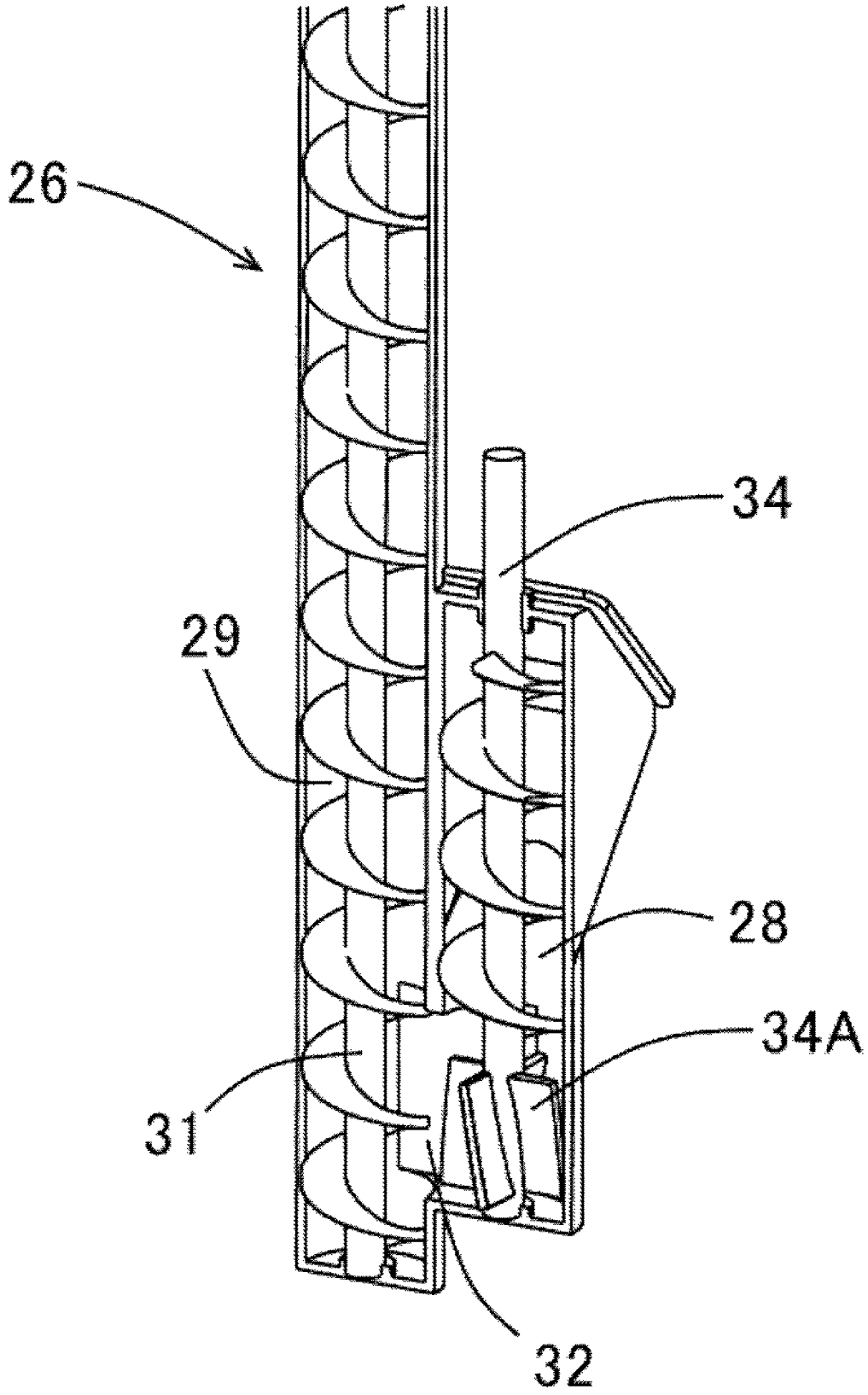
FIG. 9 is a sectional explanatory diagram of a transport member according to a third embodiment.

Next, a configuration of a third embodiment of the present invention will now be described with reference to FIG. 9. The present embodiment is provided in the first transport passage with third transport member 34 as a third rotating member which has a spiral shape and which has four ribs 34A extending in a direction intersecting the transport direction of the first transport passage outward from center of the transport direction. Stated differently, a third rotating member is provided which has four ribs 34A as rib portions extending outward in a radial direction from a rotating shaft of the first rotating member that is the first transport force generating member in the buffer portion 28 at a position corresponding to the communication port described earlier of the first rotating member.

In the present invention, the developer is handed over between the buffer portion 28 and the upward transport path 29 which are arranged parallel to and in proximity with each other. While the transport member provided in the buffer portion 28 applies a downward transport force to the developer due to the spiral shape of the transport member, proactively feeding the developer from the buffer portion 28 to the upward transport path 29 arranged in parallel to the buffer portion 28 is effective in supplying the developer to the upward transport path 29. The third transport member shown in FIG. 9 has four ribs 34A protruding and extending outward from a center of a cross section in the transport direction and, accordingly, the developer can be proactively moved and fed out from the buffer portion 28 to the upward transport path 29 via the opening 32.

While three embodiments of the present invention have been described above, the present invention is not limited to the embodiments described above and can be implemented in various modes in configurations of a developer transporting device that transports a developer upward from below. For example, while a configuration of a developer transporting device which recovers and transports the developer remaining on the intermediate transfer belt 13A after secondary transfer has been explained in the three embodiments described above, the developer transporting device may be used in a configuration in which the developer remaining on the surface of the photosensitive drum 1 after primary transfer is recovered and transported. In addition, while a transport member made of resin and having a spiral shape is adopted as the developer transporting member in the three embodiments described above, the developer transporting member may be a transport member constituted by a wire processed into a spiral shape. What is important in implementing the present invention is that a buffer portion for supplying a developer to a transport path that transports the developer upward from below is arranged in parallel to and in proximity with the transport path and that the buffer portion has the developer transporting member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-021949, filed on Feb. 9, 2018, which is hereby incorporated by reference herein in its entirety.

What is claimed is:

1. A developer transporting device, comprising:

a first transport passage through which a developer is transported in a first direction along a direction oriented downwardly in the direction of gravity;

a second transport passage, which communicates with the first transport passage on a downstream side of the first transport passage when the developer is transported in the first direction, and through which the developer is transported in a second direction along a direction oriented upwardly in the direction of gravity, wherein the first transport passage is provided with a first transport force generating member which generates a transport force for transporting the developer in the first direction, wherein the second transport passage is provided with a second transport force generating member which generates a transport force for transporting the developer in the second direction; and a communication port for communicating the first transport passage with the second transport passage and configured such that the developer therein is transported in a direction intersecting the first direction or the second direction, wherein the first transport passage and the second transport passage are arranged parallel to each other, and wherein the communication port is provided in a common portion which is common to a part of the first transport passage and a part of the second transport passage.

2. The developer transporting device according to claim 1, wherein the first transport force generating member has a first rotating member having a spiral shape, and wherein the second transport force generating member has a second rotating member having a spiral shape.

3. The developer transporting device according to claim 2, wherein the first rotating member and the second rotating member are configured so as to rotate in opposite directions.

4. The developer transporting device according to claim 2, wherein a lower end of the spiral shape of the second rotating member is configured to be positioned lower than a lower end of the spiral shape of the first rotating member.

5. The developer transporting device according to claim 4, wherein the lower end of the spiral shape of the second rotating member is configured to be positioned lower than a lower end of the communication port.

6. The developer transporting device according to claim 2, wherein the first transport force generating member has a third rotating member provided with a rotating shaft extending along the first direction and a rib portion extending outward in a radial direction from the rotating shaft at a position corresponding to the communication port, and wherein when the third rotating member rotates, the developer is moved from the first transport passage to the second transport passage by the rib portion.

7. The developer transporting device according to claim 1, wherein an opening area of the communication port is larger than a cross-sectional area of the first transport passage at a cross section perpendicular to the first direction.

8. The developer transporting device according to claim 1, wherein a transport force generated by the first transport force generating member is smaller than a transport force generated by the second transport force generating member.

9. An image forming apparatus, comprising:

an image bearing member which bears a developer image constituted by a developer; and the developer transporting device according to claim 1 which transports the developer recovered from the image bearing member.

* * * * *